US009359836B2

(12) United States Patent
Liland et al.

(10) Patent No.: US 9,359,836 B2
(45) Date of Patent: Jun. 7, 2016

(54) DEVICE FOR COMPENSATION OF WAVE INFLUENCED DISTANCE VARIATIONS ON A DRILL STRING

(71) Applicant: DEPRO AS, Bryne (NO)

(72) Inventors: Tommy Andre Hognestad Liland, Bryne (NO); Kjetil Naesgaard, Röyneberg (NO)

(73) Assignee: DEPRO AS, Bryne (NO)

( * ) Notice: Subject to any disclaimer, the term of this patent is extended or adjusted under 35 U.S.C. 154(b) by 0 days.

(21) Appl. No.: 14/384,488

(22) PCT Filed: Mar. 12, 2013

(86) PCT No.: PCT/NO2013/050049
§ 371 (c)(1),
(2) Date: Sep. 11, 2014

(87) PCT Pub. No.: WO2013/137743
PCT Pub. Date: Sep. 19, 2013

(65) Prior Publication Data

US 2015/0129238 A1 May 14, 2015

(30) Foreign Application Priority Data

Mar. 12, 2012 (NO) ..... 20120290

(51) Int. Cl.

| | |
|---|---|
| ***E21B 29/12*** | (2006.01) |
| ***B66D 1/26*** | (2006.01) |
| ***E21B 43/01*** | (2006.01) |
| ***F16L 1/16*** | (2006.01) |
| ***E21B 19/09*** | (2006.01) |
| ***E21B 19/00*** | (2006.01) |
| ***E21B 17/07*** | (2006.01) |
| ***E21B 17/01*** | (2006.01) |

(52) U.S. Cl.
CPC ..... *E21B 19/006* (2013.01); *E21B 17/01* (2013.01); *E21B 17/07* (2013.01); *E21B 19/09* (2013.01)

(58) Field of Classification Search
None
See application file for complete search history.

(56) References Cited

U.S. PATENT DOCUMENTS

| | | | | |
|---|---|---|---|---|
| 4,004,532 A | | 1/1977 | Reynolds | |
| 4,351,261 A | * | 9/1982 | Shanks | 114/264 |
| 4,362,438 A | * | 12/1982 | Spink | E21B 19/09 166/355 |

(Continued)

FOREIGN PATENT DOCUMENTS

| | | | |
|---|---|---|---|
| EP | 1428973 | A1 | 6/2004 |
| WO | 2011074984 | A1 | 6/2011 |

OTHER PUBLICATIONS

International Search Report and Written Opinion mailed Jun. 27, 2013 (PCT/NO2013/050049).

*Primary Examiner* — Matthew R Buck
*Assistant Examiner* — Douglas S Wood
(74) *Attorney, Agent, or Firm* — Alix, Yale & Ristas, LLP

(57) ABSTRACT

Device (11) for compensation of wave induced distance variations to a drill string between a floating drill rig and a seabed-fixed installation, comprising an extendable cylinder/piston unit (12) which is arranged to be able to compensate when the load exceeds a pre-determined threshold value. The cylinder (13) of the cylinder/piston unit (12) comprises a non-compressible liquid at both sides of a piston (14) positioned substantially in the middle of the cylinder (13) and is prevented from fluid communication with the surroundings. A control valve (19) is arranged to activate the device (11) by opening for fluid communication between the cylinder (13) and a gas containing accumulator (17) when the load exceeds a predetermined threshold value. The device is characterized by being a complete, self-supported unit comprising cylinder (13), piston (14) on a piston rod (15), accumulator (17), control valve (19) and drainage tank (20).

11 Claims, 2 Drawing Sheets

(56) References Cited

U.S. PATENT DOCUMENTS 4,759,256 A * 7/1988 Kovit ..... E21B 19/09 254/277
7,231,981 B2 * 6/2007 Moe ..... E21B 19/09 166/352
7,934,561 B2 * 5/2011 Ormond ..... E21B 19/006 114/264
8,021,081 B2 * 9/2011 Crotwell ..... E21B 19/002 166/355
2005/0077049 A1 4/2005 Moe et al.
2008/0304916 A1 12/2008 Crotwell et al.

* cited by examiner

DEVICE FOR COMPENSATION OF WAVE INFLUENCED DISTANCE VARIATIONS ON A DRILL STRING

BACKGROUND

The present disclosure relates to a device for compensation of wave induced distance variations on a drill string between a floating rig and a seabed-fixed installation.

When drilling offshore, it has become common to use floating units which at least during the actual drilling operation are fixedly attached to a fixed installation where the drill penetrates the seabed. For the purpose of compensating for wave induced distance changes, i.e. vertical changes in distance from the seabed to the floating drilling rig utilized, a so-called heave compensation is in continuous operations. However, such compensation will fall sooner or later, and it is thus desirable, and has eventually become a requirement, that there is an extra device to ensure that the equipment is not torn apart by the forces of waves if the primary heave compensation for any reason ceases to work.

WO publication 2011 074984 teaches a system for dealing with the above problem, comprising a trigger module for attachment to a tubing string in a heave-compensated, load-bearing unit disposed on a floating installation, wherein two or more hydraulic cylinder units form an extendable connection between the heave-compensated, load-bearing unit and a portion of the tubing string. The hydraulic cylinder unit must have fluid communication with an accumulator unit and there is a need for hydraulics and accumulator fluid pipes between the hydraulic cylinder unit and a gas reservoir in a suitable manner. A disadvantage with this solution is that the accumulator is not arranged on the heave compensated unit. This gives a higher risk of a safety failure, since the fluid communication pipe is exposed to external elements that might deform it or tear it apart.

The installation time for the described heave compensated unit can be extensive and there is a risk of erroneous installation due to the number of components of the system. Any errors might lead to a stop in the floating installation in question and damage to the equipment, There is thus still a need for a simple, robust, compact and reliable device that can ensure that the need for wave induced distance variations between a floating rig and a seabed-fixed installation.

SUMMARY

The disclosed device is capable of compensating wave induced distance variations between a floating drill rig and a seabed-fixed installation, while being compact, robust, and comparatively inexpensive in production and which requires little maintenance.

The system described is subject to SIL 2 according to IEC 61508 for ensuring reliable activation.

The complete, self-supported unit does not need external supply either in the form of electricity or other kind of energy, since the energy and the controlling mechanism needed for the unit to be operative, is supplied by the unit itself. There is thus no need for pipes or cables to the unit which is just mounted to the drill string in question and is then in a state of readiness, until the activation point defined by the separate floating unit is reached. The installation of the disclosed device is significantly quicker and safer than the previously known devices or systems, due to it being an independent heave compensating unit. The surrounding environmental aspects will also experience reduced risk of unintentional contaminations due to reduced risk of system failure.

DETAILED DESCRIPTION

Figure 1:
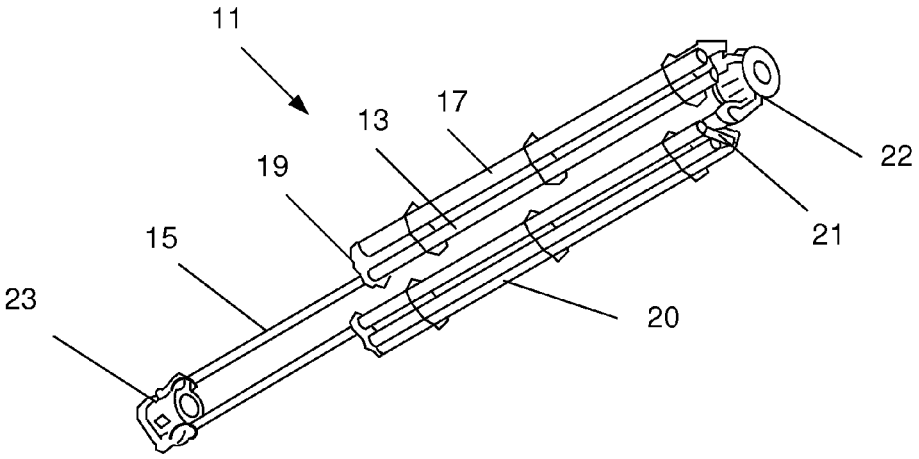
FIG. 1 shows a perspectival drawing of the disclosed device.

FIG. 1 shows an embodiment of the disclosed device 11, comprising extendable cylinders/piston units 12 wherein the cylinders 13 have their closed end facing upwards while the piston rods 15 extend downward from the cylinders. The pistons are hidden within the cylinders 13 in FIG. 1. FIG. 1 also shows accumulators 17, control valve 19, drainage tanks 20 and dump valve 21. An upper attachment collar 22 is shown at the top and a lower attachment collar is shown at the bottom, for attachment to an element of a unit which provides heave compensation to a drill string on one side and either fixed equipment or another element of heave compensated drill string on the opposite side. Preferably the disclosed device is used at the surface, the upper attachment collar 22 being attached to a drill apparatus (not shown) while the lower attachment collar 23 is attached to a unit which heave compensates a drill string.

Figure 2A:
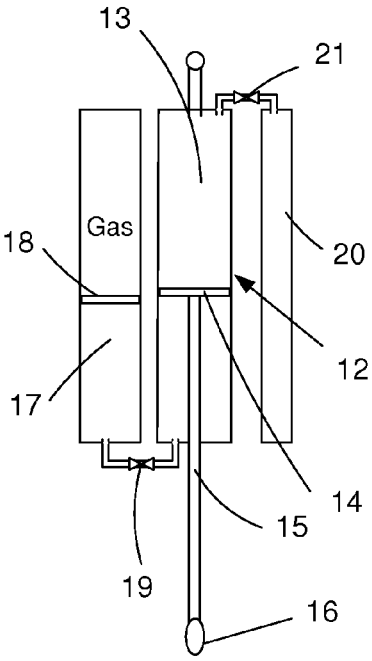
FIGS. 2*a*-2*c* show, in a simplified manner, the operation of the disclosed device in three different positions or phases.
Figure 2B:
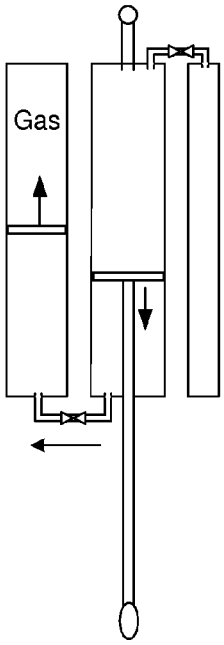
Figure 2C:
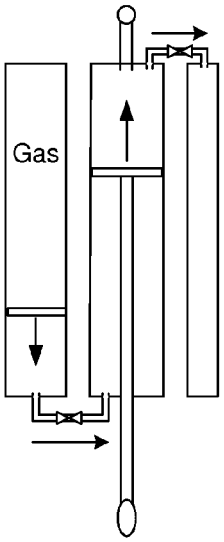

FIGS. 2*a*-2*c* illustrate the operation of the disclosed device in a simple way. While FIG. 1 shows a realistic appearance for the device, FIG. 2 only illustrates functional principles. FIGS. 2*a*-2*c* shows the extendable cylinder/piston unit 12, comprising cylinder 13, piston 14, piston rod 15 and an attachment ear 16 on the piston rod. The cylinder has its closed end facing upwards while the piston rod 15 protrudes downwards from the cylinder 13. The piston 14 is shown about a middle vertical position within the cylinder 13. An accumulator 17, accumulator piston 18, control valve 19, drainage tank 20 and dump valve 21 are also shown. The cylinder 13 is filled with a non-compressible liquid and the valves 19, 21 are closed; therefore piston 14 is stationary within the cylinder 13 and compressional forces and tensional forces may be transmitted over the cylinder/piston unit 12 without moving the piston. In FIG. 2*b* a situation is shown in which pressure has exceeded a threshold value so that the control valve 19 has been opened allowing fluid communication between the accumulator 17 and the bottom side of the cylinder 13. Optionally the dump valve 21 opens simultaneously with the control valve 19, in which case there is in this stage also open connection between the top side of the cylinder 13 and the drainage tank 20. With a tensional force to the cylinder/piston unit 12, the piston 14 will now move downwards and expel liquid from the cylinder 13 to the accumulator 17, where an accumulator piston 18 that at all times separates gas from liquid, is displaced in an upwards direction in the accumulator against an increasing counter-force as the gas above the accumulator piston is compressed to higher and higher pressures. The weight of the platform and its equipment will, however, be so large that the wave height determines to what extent the accumulator piston 18 is moved upwards in the accumulator and thereby how far the piston 14 is pulled downwards in the cylinder 13. If the dump valve 21 remains closed in this stage, an underpressure is created above the piston 14 in the cylinder 13, which also contributes to slow down the movement of the pistons 14 and 18. A simpler function is to "force control" the dump valve 21 in a manner ensuring that it is always closed when control valve 19 is closed and always open when control valve 19 is open, since the unit functions well this way and no separate control mechanism is then required for the dump valve 21. It should be emphasized that even if control valve 19 and dump valve 21 are discussed in in their singular form, there is typically one control valve per accumulator and one dump valve per drainage tank, so there may be two or more of each of these valves in one and the same device. With regard to the control valves 19, these have as the designation indicates, a built in trigger function that allows the valve to open at a certain pressure. Alternatively the valve may be in contact with one or more pressure sensors (not shown) included in the device, producing signal for opening of the control valve 19. For simplicity the designation "control valve" is used also if external sensors control the opening of the valve. The control valve or valves 19 may advantageously be arranged to measure pressure continuously. When it opens at a predetermined pressure to thereby activate the device 11 allowing fluid communication between cylinder 13 and accumulator 17, the length of the cylinder/piston unit 12 may be freely changed within mechanically determined limits. When the platform passes a wave-top and moves towards a wave-bottom, the situation shown in FIG. 2*c* occurs. The piston 14 in the cylinder 13 is forced upwards so that the length of the cylinder/piston unit 12 is reduced. The piston 14 then sucks liquid back from the accumulator 17 into the cylinder 13 while liquid above the piston 14 is forced into the drainage tank 20 via dump valve 21, which, independent of whether having been open or closed in the above discussed stage, is open in this stage, controlled by a control signal from the control valve or controlled by pressure.

In general, after the control valve has been opened and until it is manually or automatically closed, there is a dynamic balance in the system, determined by the wave variations influencing the floating construction and slowed or moderated by the pressure in the accumulator 17.

Figure 3:
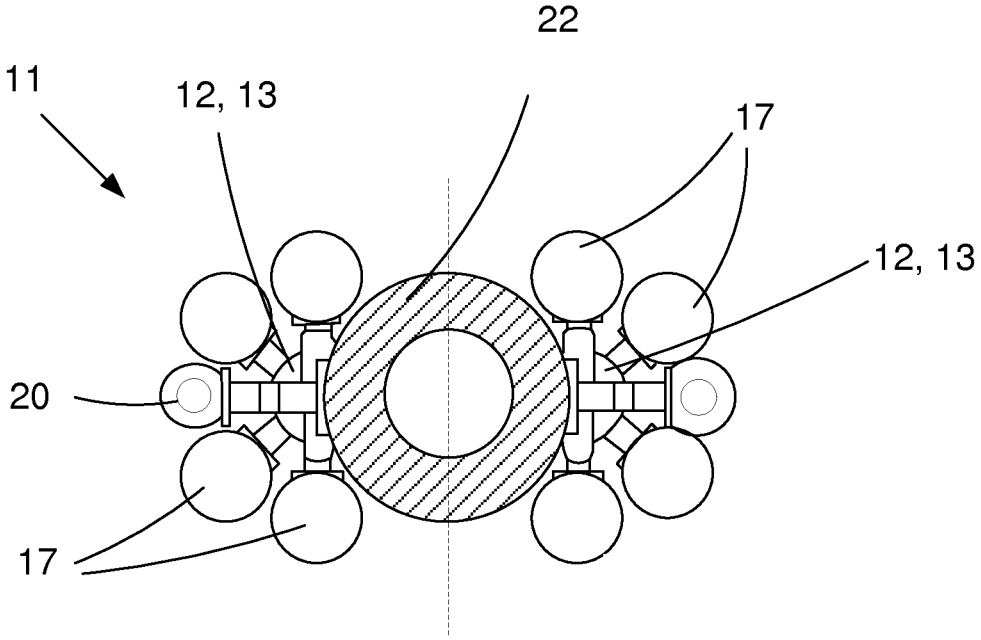
FIG. 3 shows an end cross-sectional view of the device shown in FIG. 1.

FIG. 3 shows an end view of the device shown in FIG. 1 (and which is principally illustrated in the FIGS. 2*a*-2*c*). Here an upper connection flange 22 is shown, two extendable cylinder/piston units 12, eight accumulators 17 and two drainage tanks 20. It is worth noticing that the extendable cylinder/piston units 12 typically are arranged in pairs, and that there may be two or more accumulators 17 and at least one drainage tank 20 for each respective cylinder/piston unit 12. In general, the device typically comprises at least two extendable cylinder/piston units 12 and at least one accumulator 17 and at least one drainage tank 20 per cylinder/piston unit 12.

The disclosed device provides a secondary or reserve compensation for wave induced distance variations between a floating structure and a seabed-fixed construction which automatically is activated when a primary heave-compensation should fail.

The device may also be utilized as a stand-alone unit which is 100% self-supported and does not need to be connected to external sources of energy or fluid to be operative. Thus the unit is principally less vulnerable to interruption or failure in such external supply cables and pipes. When the device according to the present invention is connected to a section of a drill string at one end and either another part of a drill string or a part of the floating or fixed construction at the other end, it is always ready for use. In addition to increased operational safety this also allows simpler connection and disconnection for maintenance. There is also an environmental aspect with regard to the reduced risk for failure in fluid transmitting pipes.

The invention claimed is:

1. A device for compensation of wave induced distance variations to a drill string between a floating drill rig and a seabed-fixed installation, comprising an extendable cylinder/piston unit (12) configured to be able to compensate when the load exceeds a pre-determined threshold value, the cylinder/piston unit (12) including a reciprocable piston (14) within a coaxial longitudinally extending cylinder (13) with a non-compressible liquid at both longitudinal sides of a piston (14), the piston (14) positioned substantially in the longitudinal middle of the cylinder (13) and being prevented from fluid communication with the surroundings in the base position, wherein at least one control valve (19) is arranged between the cylinder (13) and at least one gas containing accumulator (17) for activating the device (11) into an activated position by opening to allow fluid communication between the cylinder (13) and the at least one gas containing accumulator (17) when the load exceeds a pre-determined threshold value, the device (11) being a complete self-supported unit and a closed system during regular operation comprising the cylinder (13), the piston (14) on a piston rod (15), the accumulator (17), the control valve (19) and a drainage tank (20).

2. The device (11) of claim 1, wherein each of the at least one gas containing accumulators (17) in its base position is filled with gas under pressure and connected to a separate control valve (19) for activation to allow fluid flow into and out from the gas containing accumulator (17) that is connected.

3. The device (11) of claim 1, comprising at least one drainage tank (20) that temporarily receives excess liquid from the cylinder (13) when the device is activated, and a dump valve (21) between the cylinder (13) and the drainage tank (20) arranged to open to allow communication of said excess liquid.

4. The device (11) of claim 3, wherein all liquids are non-compressible.

5. The device (11) of claim 1, wherein all liquids are non-compressible.

6. The device (11) of claim 1, wherein the cylinder/piston unit (12) in its base position has a longitudinal length and is rigid, whereby the cylinder/piston unit (12) can transmit longitudinal tensional and compressional forces without changing its length.

7. The device (11) of claim 1, wherein the at least one control valve (19) is arranged to measure the pressure continuously and to open at a pre-determined threshold pressure, thereby activating the device (11) to allow fluid communication between the cylinder (13) and the at least one gas containing accumulator (17), thereby allowing the length of the cylinder/piston unit (12) to be freely hanged within mechanically determined limits.

8. The device (11) of claim 1, wherein after activation the device remains in the activated position until it is manually switched back to base position.

9. The device (11) of claim 1, comprising at least two cylinder/piston units (12), at least one gas containing accumulator (17), and at least one drainage tank (20) per cylinder/piston unit (12).

10. The device (11) of claim 1, wherein the at least one control valve (19) is activated by passive reactivity to outside forces.

11. The device (11) of claim 1, wherein the device (11) requires no external source of fluid.

* * * * *